US008013233B2

(12) United States Patent
Komatsu

(10) Patent No.: US 8,013,233 B2
(45) Date of Patent: Sep. 6, 2011

(54) KEYBOARD APPARATUS

(75) Inventor: Akihiko Komatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 101 days.

(21) Appl. No.: 12/253,674

(22) Filed: Oct. 17, 2008

(65) Prior Publication Data

US 2009/0100993 A1 Apr. 23, 2009

(30) Foreign Application Priority Data

Oct. 19, 2007 (JP) ..... 2007-272600

(51) Int. Cl.
*G10H 3/06* (2006.01)

(52) U.S. Cl. ..... 84/724

(58) Field of Classification Search ..... 84/724, 84/719, 744, 16
See application file for complete search history.

(56) References Cited

U.S. PATENT DOCUMENTS

| | | | | |
|---|---|---|---|---|
| 6,420,642 | B1 | 7/2002 | Muramatsu et al. | |
| 7,285,718 | B2 * | 10/2007 | Sasaki | 84/744 |
| 2003/0025071 | A1 | 2/2003 | Kato et al. | |
| 2004/0065811 | A1 | 4/2004 | Kato | |
| 2005/0139060 | A1 * | 6/2005 | Muramatsu | 84/719 |
| 2005/0188810 | A1 | 9/2005 | Meisel | |

FOREIGN PATENT DOCUMENTS

| | | | |
|---|---|---|---|
| JP | 06161430 | | 6/1994 |
| JP | 2001034261 | A * | 2/2001 |
| JP | 2005-195619 | A | 7/2005 |

OTHER PUBLICATIONS

European Search Report dated Feb. 23, 2009 for Application No. 08166900.4-2225.

* cited by examiner

*Primary Examiner* — Jianchun Qin
(74) *Attorney, Agent, or Firm* — Morrison & Foerster LLP

(57) ABSTRACT

A keyboard apparatus includes plural keys, electronic actuators, reflection plates, and optical sensors. Each key extends in the longitudinal direction and pivots in the vertical direction about a support in accordance with key depression and release. Each electronic actuator has a movable member that displaces vertically when interlocking with a key's pivot movement so as to apply a reaction force against key depression. Each plural reflection plate is fixed to the electronic actuator's movable member, wherein the reflection surface faces the lateral direction of each of the keys. The light reflectance changes along the displacing direction of the movable member. Each optical sensor is arranged apart from the longitudinal axis of the keys in the lateral direction. It emits light toward the reflection plate and receives the reflected light from the reflection plate so as to output an electric signal according to the quantity of received light.

5 Claims, 6 Drawing Sheets

KEYBOARD APPARATUS

BACKGROUND OF THE INVENTION

1. Field of the Invention

The present invention relates to a keyboard apparatus having plural keys, and more particularly to a keyboard apparatus having electronic actuators that apply a reaction force with respect to the operation of depressing the plural keys.

2. Description of the Related Art

A natural keyboard instrument such as an acoustic piano or the like is configured to generate a live sound by a hammer, which rotates with the key depression, striking a string, for example. The natural keyboard apparatus of this type has a so-called action mechanism provided between a key, which is a performance operation element, and a hammer. A player receives a unique reaction force (key damping force) from the key by this action mechanism. Specifically, a feeling of a key touch specific to the natural keyboard instrument can be obtained by providing the action mechanism.

On the other hand, in a conventional electronic keyboard instrument, such as an electronic piano, that generates an electronic sound, a mechanical structure, such as a spring or a mass body (hammer) member, that returns a key to an initial position is provided in order to simulate a touch feeling of a natural keyboard apparatus such as an acoustic piano. A player operates a key against the returning force of the spring or the mass body member when he/she depresses the key. In general, the mechanical structure of the electronic keyboard apparatus is compact and not complicated, compared to the action mechanism of the natural keyboard apparatus, so that the touch feeling of a key in the electronic keyboard apparatus is different from the touch feeling of the natural keyboard apparatus, to be strict.

In view of this, there has been proposed a keyboard apparatus in which a key is driven by driving means, such as an electromagnetic solenoid, for changing the reaction force against the key depression, in order to provide a touch feeling similar to that of a natural keyboard instrument in an electronic keyboard instrument. In this keyboard apparatus, the key is driven by the electromagnetic solenoid in such a manner that a position of a movable member of the electromagnetic solenoid is detected, and the key is driven in accordance with the detected position. The keyboard apparatus of this type is, for example, configured as illustrated in FIGS. 6A and 6B (see Japanese Unexamined Patent Application No. 2005-195619).

The keyboard apparatus described above has plural white keys 10 and black keys 11 arranged in the lateral direction, and plural actuator sections 40 and position sensor sections 50 corresponding respectively to the plural white keys 10 and black keys 11. The actuator sections 40 and the position sensor sections 50 are arranged side by side in two rows along the lateral direction of the white keys 10 and the black keys 11. Each of the actuator sections 40 is composed of an electromagnetic solenoid. Each of the position sensor sections 50 includes a reflection plate 51 and an optical sensor 52 for detecting the position of the height of a plunger (movable member) 41 in the actuator section 40. The reflection plate 51 is fixed to the plunger 41, and the light reflectance is changed along the driving direction of the plunger 41. The optical sensor 52 is composed of a light-emitting device that emits light toward the reflection plate 51, and a light-receiving device that receives light, which is reflected by the reflection plate 51, from the light-emitting device, whereby it outputs an electric signal in accordance with the quantity of light received by the light-receiving device as the position of the plunger 41.

However, in the keyboard apparatus described above, a mechanical looseness (microclearance) is caused between a bobbin 42*c* and the plunger 41. A friction force in the longitudinal direction is applied between the lower end of the plunger 41 and the white key 10 and the black key 11 when the key is depressed or released. Therefore, the plunger 41 clatters in the longitudinal direction Y2 by the vertical movement (pivot movement) of the white key 10 and the black key 11. In the conventional keyboard apparatus, the reflection plate 51 is fixed to the plunger 41 in such a manner that the orthogonal direction Y1 orthogonal to the surface of the reflection plate 51 and the longitudinal direction Y2 of the white key 10 and the black key 11 are parallel to each other. Therefore, when the plunger 41 clatters in the longitudinal direction Y2, the reflection plate 51 also clatters in the longitudinal direction Y2, so that the distances L1 and L2 between the reflection plate 51 and the optical sensor 52 vary as shown in FIG. 4B.

Further, the clattering direction of the plunger 41 upon the key depression and the clattering direction thereof upon the key release are different from each other, whereby the distance L1 upon the key depression and the distance L2 upon the key release are different from each other even if the plunger 41 is located at the position of the same height. Therefore, as shown in FIG. 5A, a problem arises that the voltage signal outputted from the optical sensor 52 is different between the case of the key depression and the case of the key release, i.e., a hysteresis characteristic is generated. Due to this hysteresis, the voltage signal outputted from the optical sensor 52 is different between the case of the key depression and the case of the key release, even if the plunger 41 is located at the position of the same height, thereby entailing a problem that the position of the plunger 41 cannot be specified from the voltage signal. A method of correcting the hysteresis has been considered, but a complicated process is needed for this method.

SUMMARY OF THE INVENTION

In view of the foregoing circumstance, the present invention aims to provide a keyboard apparatus that can enhance the precision in detecting the position of the movable member.

In order to solve the aforesaid problem, the keyboard apparatus according to the present invention includes plural keys, electronic actuators, reflection plates, and optical sensors. Each of the plural keys extends in the longitudinal direction, and pivots in the vertical direction about a support in accordance with the key depression and key release. Each of the plural electronic actuators has a movable member that displaces in the vertical direction in interlocking with the pivot movement of each of the keys so as to apply a reaction force against the operation of depressing the key. Each of the plural reflection plates is fixed to the movable member of the electronic actuator, wherein the reflection surface thereof faces in the lateral direction of each of the keys. The light reflectance of each of the reflection plates changes along the displacing direction of the movable member. Each of the plural optical sensors is arranged at the position apart from the longitudinal axis of each of the keys in the lateral direction. It emits light toward the corresponding reflection plate and receives the reflected light from the reflection plate so as to output an electric signal according to the quantity of the received light.

In this case, each of the plural electronic actuators is an electromagnetic solenoid. The electronic actuators apply a reaction force with respect to the upward displacement of the movable members. The light reflectance of each of the reflection plates gradually changes along the displacing direction of each of the movable members, for example. Each of the optical sensors is composed of, for example, a light-emitting device that faces the corresponding reflection plate and emits light toward the reflection plate, and a light-receiving device that faces the reflection plate and receives light from the light-emitting device reflected by the reflection plate so as to output an electric signal according to the quantity of the received light.

Each of the electronic actuators applies a reaction force with respect to the operation of depressing each of the keys through each of the movable members at the position at the front side from the support of each of the keys. Each of the electronic actuators may apply a reaction force with respect to the operation of depressing each of the keys through each of the movable members at the position at the rear side from the support of each of the keys.

The angle between the longitudinal axis of each of the keys and the direction orthogonal to the surface of each of the reflection plates is preferably 700° or more and 110° or less. More preferably, the angle between the longitudinal axis of each of the keys and the direction orthogonal to the surface of each of the reflection plates is 90°.

In the present invention thus configured, the reflection surfaces of the reflection plates are directed in the lateral direction of the keys, and the optical sensors are arranged at the position apart from the longitudinal axes of the keys in the lateral direction. Therefore, even if the movable members clatter in the longitudinal direction in accordance with the operation of depressing and releasing the keys, the variation in the distance between each of the reflection plates and the each of the optical sensors can be suppressed to be small, whereby the hysteresis generated in the electric signal according to the quantity of received light outputted from each of the optical sensors can be suppressed. Accordingly, the keyboard apparatus that can enhance the precision in detecting the position of each of the movable members can be provided with reduced cost.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
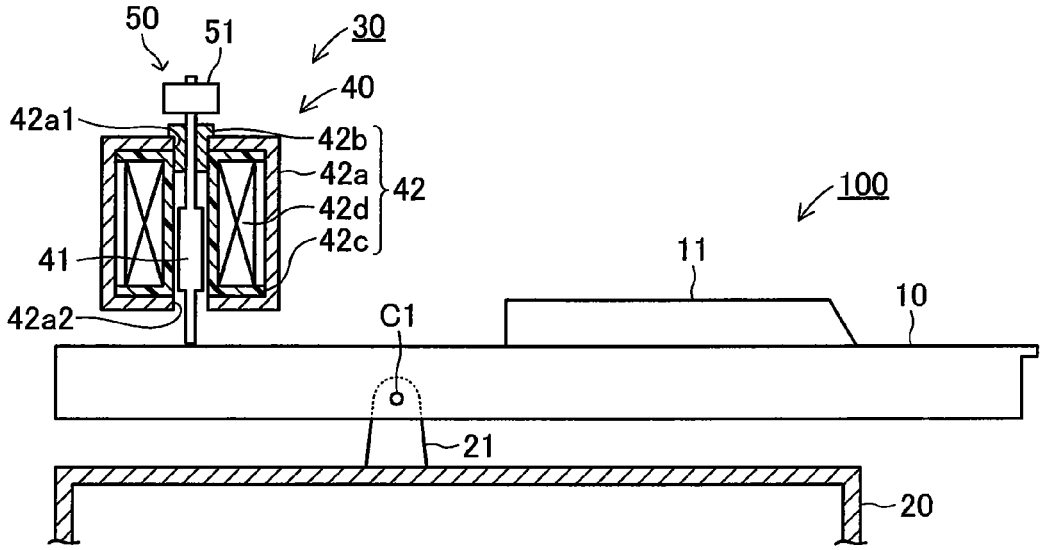
FIG. 1 is a schematic sectional view showing an embodiment of a keyboard apparatus according to the present invention.
Figure 2:
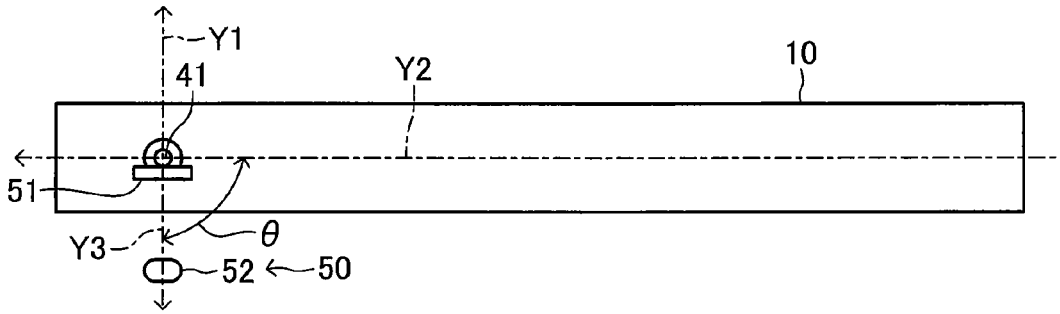
FIG. 2 is a top view of the keyboard apparatus in which only a plunger of the electromagnetic solenoid shown in FIG. 1 is illustrated.
Figure 3:
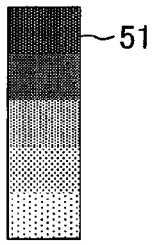
FIG. 3 is a front view of the reflection plate shown in FIG. 1.

An embodiment of the present invention will be described below with reference to the drawings. FIG. 1 is a schematic sectional view showing an embodiment of a keyboard apparatus 100 according to the present invention. FIG. 2 is a top view showing the keyboard apparatus 100 in which only a plunger 41 of an electromagnetic solenoid in FIG. 1 is left. FIG. 3 is a front view of a reflection plate 51 shown in FIG. 1. In the description below, the "vertical direction, lateral direction, and longitudinal direction" of the keyboard apparatus 100 mean the "vertical direction, lateral direction, and longitudinal direction" as viewed from a player who plays the keyboard apparatus 100.

The keyboard apparatus 100 is used for an electronic keyboard instrument, for example. As shown in the figures, the keyboard apparatus 100 includes plural white keys 10 and black keys 11, which serve as performance operation elements, a frame 20, and a driving unit 30. The white keys 10 and the black keys 11 are juxtaposed in the lateral direction. The frame 20 is formed to have a plate-like shape, or a box-like shape having an opening at the bottom surface thereof. Speed sensors (not shown) for detecting the key depression speed of the white keys 10 and the black keys 11 are provided below the white keys 10 and the black keys 11 or in the frame 20.

A key supporting section 21 that supports the central part of each of the white keys 10 and the black keys 11 is provided in such a manner that the front ends of the white key 10 and the black key 11 are pivotable in the vertical direction. The white key 10 and the black key 11 are pivotally supported by the key supporting sections 21, so that the white key 10 and the black key 11 pivot in the vertical direction about the support C1.

The driving unit 30 includes plural actuator sections 40 serving as driving means composed of an electromagnetic solenoid, and plural position sensor sections 50 that detect the positions of plungers 41 in the actuator sections 40. Each of the actuator sections 40 is composed of the plunger 41 serving as a movable member and a driving section 42 fixed to an unillustrated casing. The plunger 41 is made of a ferromagnetic material. The plunger 41 is mounted such that the lower end thereof is brought into contact with the upper surface of the white key 10 at the rear from the support C1, thereby applying a reaction force from above the white key 10. The driving section 42 is composed of a magnetic frame 42*a*, a stationary core 42*b*, a bobbin 42*c*, and a coil 42*d*.

The magnetic frame 42*a* is made of a ferromagnetic material. The magnetic frame 42*a* has housed therein the plunger 41, the stationary core 42*b*, the bobbin 42*c*, and the coil 42*d*. An upper opening 42*a*1 and a lower opening 42*a*2 are formed at the upper surface and the lower surface of the magnetic frame 42*a*. The plunger 41 is housed in the magnetic frame 42*a* so as to have the lower end projecting from the lower opening 42*a*2 and so as to be movable in the vertical direction. The plunger 41 is mounted in such a manner that the upper end thereof projects from the upper opening 42*a*1 through a through-hole formed to the later-described stationary core 42*b*. The stationary core 42*b* is attached and fixed to the magnetic frame 42*a* for closing the upper opening 42*a*1. Specifically, the plunger 41 and the stationary core 42*b* are housed in the magnetic frame 42*a* as arranged side by side in the vertical direction.

The bobbin 42*c* is made of an insulating material. The bobbin 42*c* is formed into a cylindrical shape, wherein the plunger 41 and the stationary core 42*b* are stored in the cylinder. The coil 42*d* is made of a copper wire, and is wound around the bobbin 42*c*. The driving section 42 controls the attraction force exerted between the plunger 41 and the stationary core 42*b* through the control of the current flowing through the coil 42*d*, whereby the plunger 41 linearly moves in the vertical direction so as to apply an external force (a reaction force against the key depression) to the white key 10. The current flowing through the coil 42*d* is controlled by a computer not shown. The computer controls the current flowing through the coil 42*d* in order to obtain a key touch feeling, which is similar to that of a natural keyboard instrument, according to the position or speed of the white key 10, thereby controlling the external force (the reaction force against the key depression) applied to the white key 10. In FIG. 1, the driving unit 30 is provided to the white key 10, but the driving unit 30 is similarly provided to the black key 11 so as to apply the external force (the reaction force against the key depression).

Each of the position sensor sections 50 includes a reflection plate 51 fixed to the plunger 41 and an optical sensor 52 fixed to the driving section 42 or to the casing to which the driving section 42 is fixed. As shown in FIG. 3, the reflection plate 51 is formed to have a plate-like shape, and has formed on its surface a predetermined gray-scale pattern (gray-scale) made of a white portion and a black portion. The gray-scale pattern is formed such that the area ratio of the white portion (or the black portion) occupying the surface of the reflection plate 51 increases (or decreases) along the driving direction of the plunger 41. In the example shown in FIG. 3, the gray-scale pattern is formed such that the area ratio of the white portion (or the black portion) on the reflection plate 51 stepwisely increases (or decreases). However, the gray-scale pattern may be formed such that the white portion (or the black portion) of the reflection plate 51 continuously increases (or decreases). The gray-scale pattern allows the light reflectance of the reflection plate 51 to change in accordance with the driving direction of the plunger 41. As shown in FIG. 2, the reflection plate 51 is fixed to the plunger 41 in such a manner that the angle θ, which is made by the orthogonal direction Y1 orthogonal to the surface of the reflection plate 51 and the longitudinal axis Y2 of the white key 10 and the black key 11, falls within 90°±20°.

The optical sensor 52 is arranged at the position apart from the longitudinal axis Y2 of the white key 10 and the black key 11 in the lateral direction. The optical sensor 52 is composed of an unillustrated light-emitting device that emits light toward the reflection plate 51, and an unillustrated light-receiving device that receives light, which is reflected by the reflection plate 51, from the light-emitting device. The optical sensor 52 outputs an electrical signal according to the quantity of the received light by the light-receiving device to an unillustrated microcomputer. The light-emitting device in the optical sensor 52 is mounted such that the emitting direction Y3 of light becomes 90° with respect to the reflection plate 51. The unillustrated microcomputer detects the position of the height of the plunger 41 (=the positions of the white key 10 and the black key 11) on the basis of the electric signal from the light-receiving device.

The aforesaid plunger 41 clatters in the longitudinal direction (in the direction of the axis Y2) by the force applied thereto in the longitudinal direction (in the direction of the axis Y2) with the pivot movement of the white key 10 and the black key 11. On the other hand, the plunger 41 hardly clatters in the lateral direction. In view of this, the reflection plate 51 is fixed to the plunger 41 in such a manner that the angle θ, which is made by the orthogonal direction Y1 orthogonal to the surface of the reflection plate 51 and the longitudinal direction (in the direction of the axis Y2) of the white key 10 and the black key 11, falls within 90°±20°, i.e., assumes approximately 90°, as shown in FIG. 2.

Figure 4A:
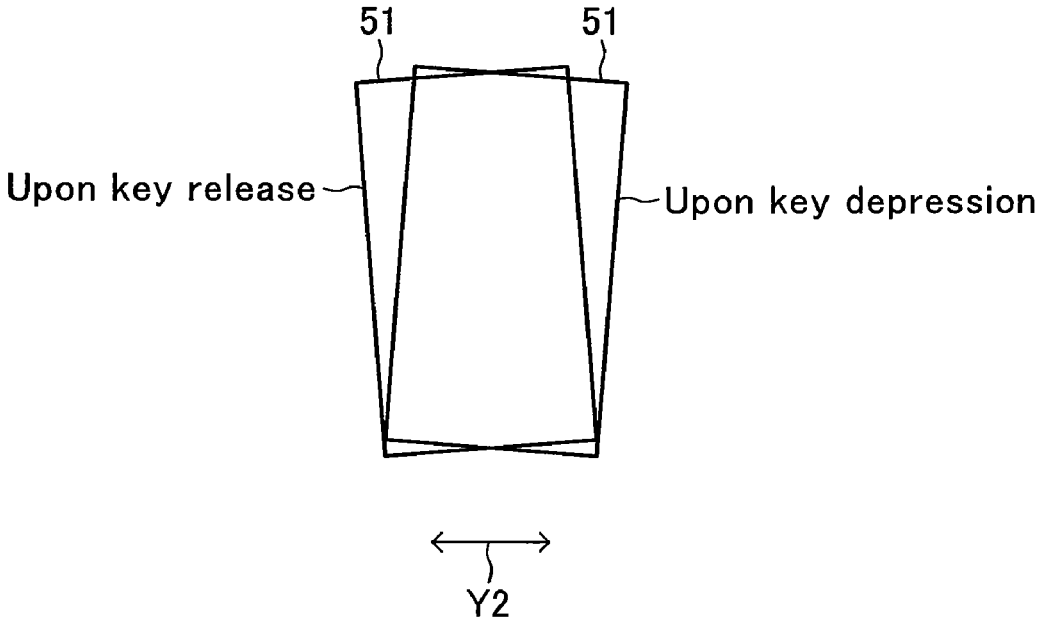
FIG. 4A is a view of the reflection plate viewed in lateral direction for explaining a looseness caused on the reflection plate of the keyboard apparatus according to the present invention shown in FIG. 1.
Figure 4B:
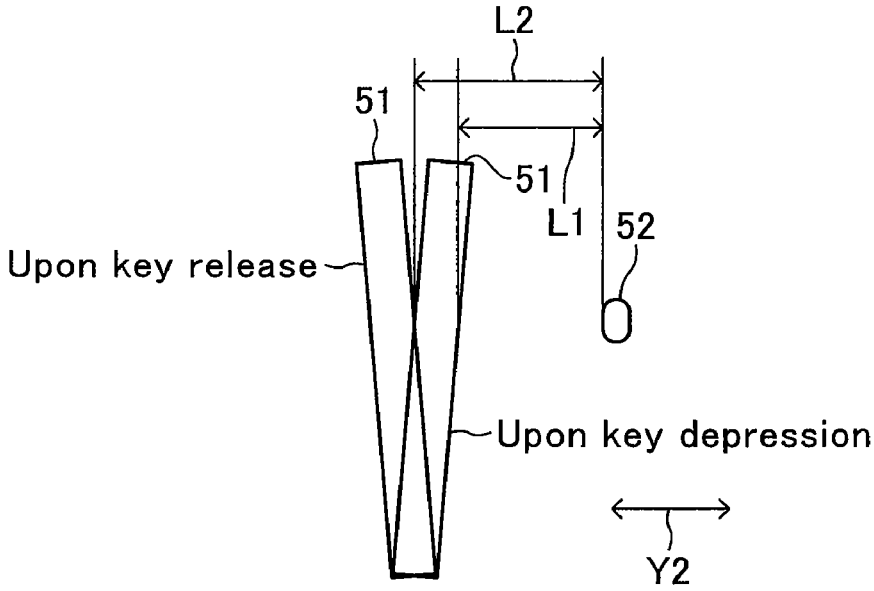
FIG. 4B is a view of a reflection plate as viewed in the lateral direction for explaining a looseness caused on the reflection plate of a conventional keyboard apparatus shown in FIGS. 6A and 6B.

With this configuration, even if the plunger 41 clatters in the longitudinal direction (in the direction of the axis Y2), only the reflection plate 51 clatters as shown in FIG. 4A, which means that the configuration prevents the plunger 41 from clattering such that the distances L1 and L2 between the reflection plate 51 and the optical sensor 52 vary as in the conventional case as shown in FIG. 4B. Accordingly, the variation in the distance between the reflection plate 51 and the optical sensor 52 can be suppressed to a lower level, with the result that the hysteresis generated in the electric signal outputted from the light-receiving device can be suppressed. Therefore, a process for eliminating the hysteresis in the electric signal outputted from the light-receiving device is not needed, whereby the driving unit 30, which intends to enhance the precision in the positional detection of the plunger 41, can be provided with reduced cost.

The present inventor has verified the electric signal outputted from the optical sensor 52 through the experiment, when the angle θ, which is made by the orthogonal direction Y1 orthogonal to the surface of the reflection plate 51 and the longitudinal direction (in the direction of the axis Y2) of the white key 10 and the black key 11, is varied such as 0°, 22.5°, 45°, 67.5°, 90°, 112.5°, 135°, 157.5°, and 180°. The result of the experiment is shown in FIGS. 5A to 5I.

Figure 5A:
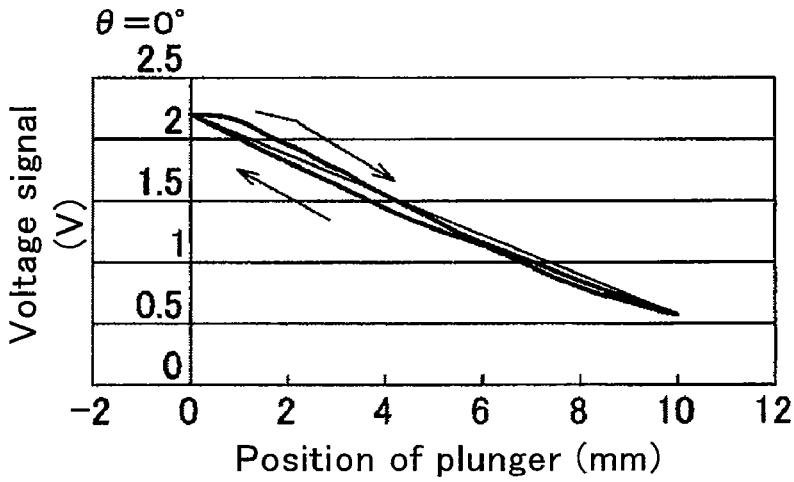
FIGS. 5A to 5I are graphs each showing a relationship between an electric signal outputted from an optical sensor and a position of the plunger, when the angle θ varies such as 0°, 22.5°, 45°, 67.5°, 90°, 112.5°, 135°, 157.5°, and 180°.
Figure 5B:
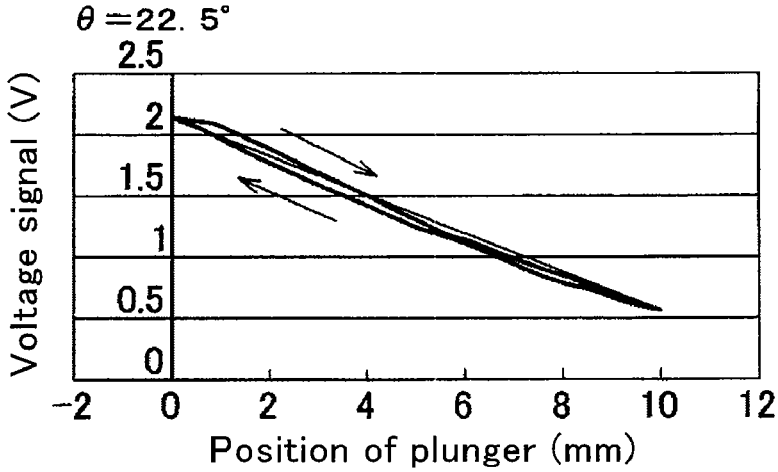
Figure 5C:
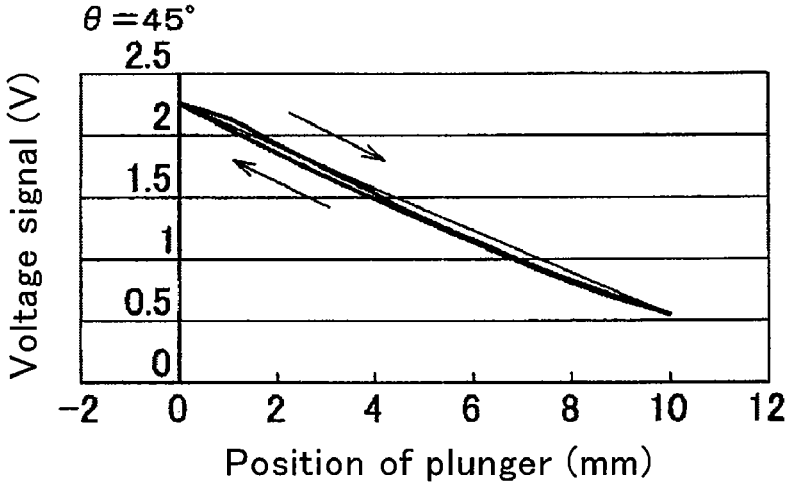
Figure 5D:
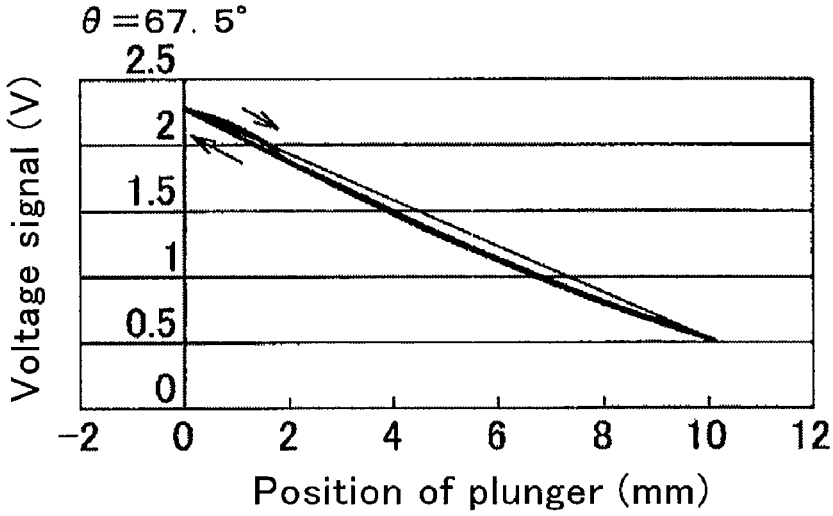
Figure 5E:
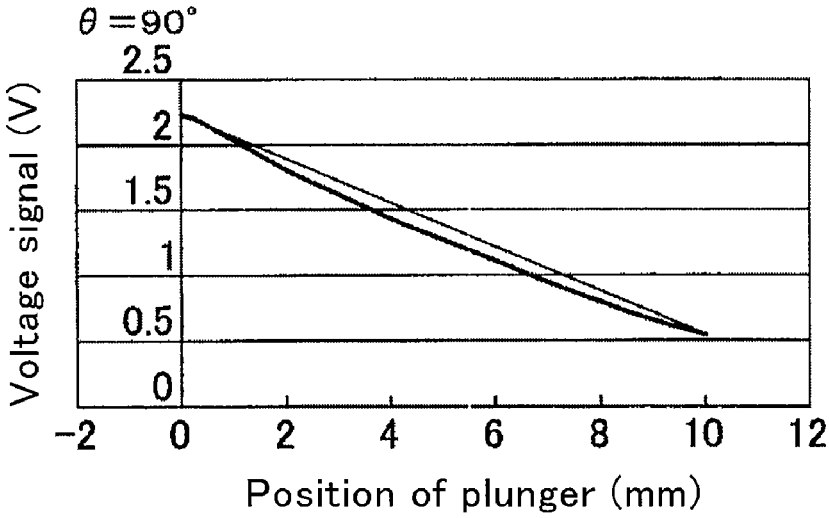
Figure 5F:
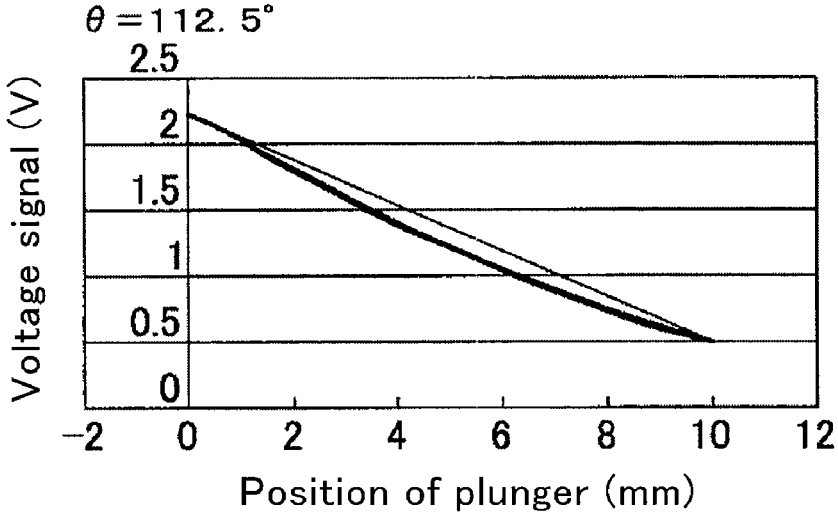
Figure 5G:
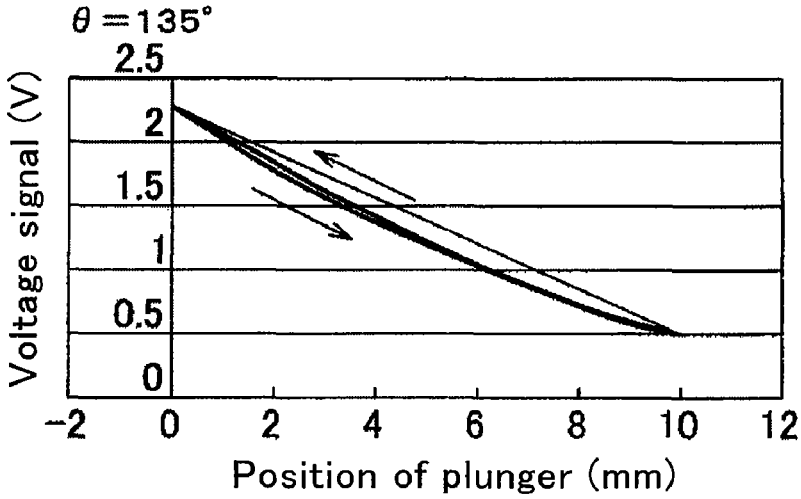
Figure 5H:
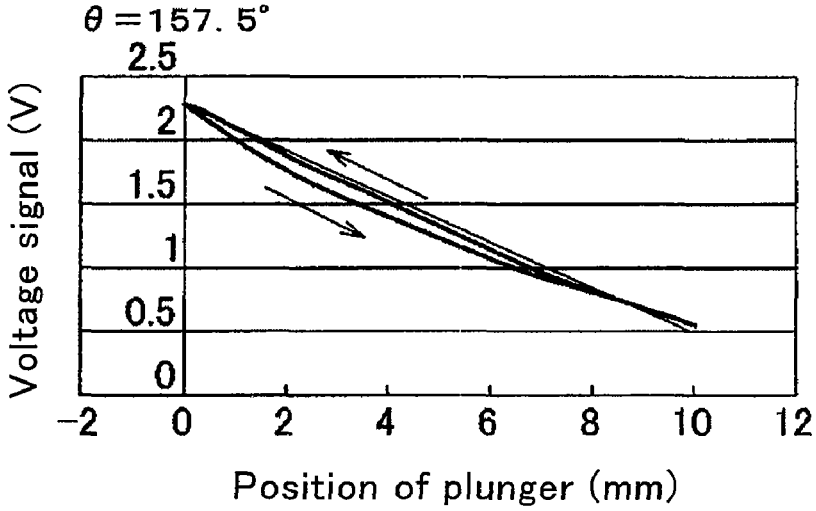
Figure 5I:
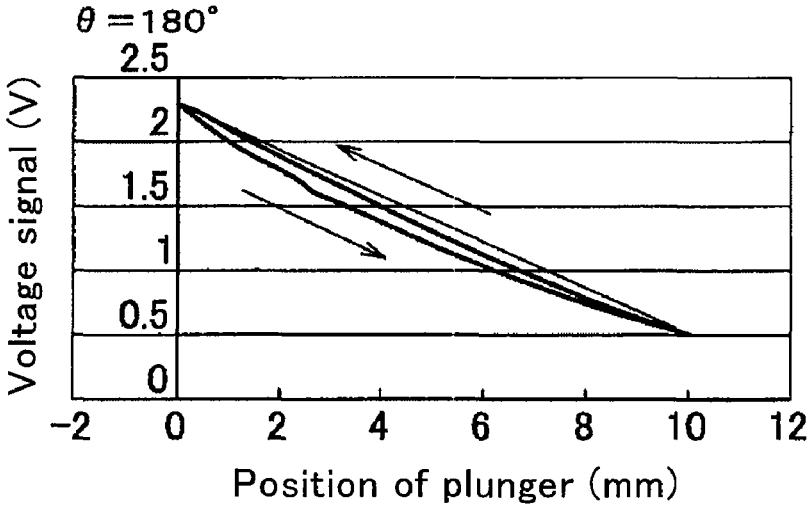
Figure 6A:
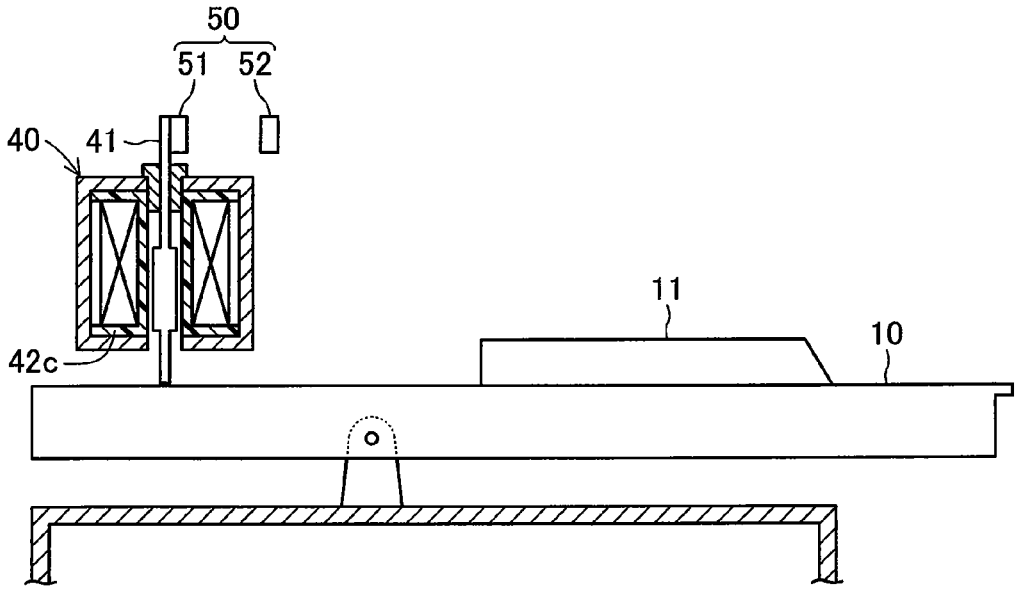
FIG. 6A is a schematic sectional view showing an embodiment of a conventional keyboard apparatus.
Figure 6B:
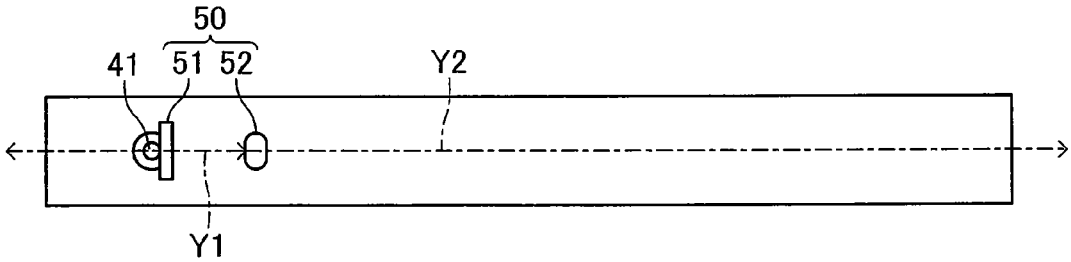
FIG. 6B is a top view showing the keyboard apparatus in which only a plunger of the electromagnetic solenoid shown in FIG. 6A is illustrated.

As shown in FIGS. 5A to 5C and 5G to 5I, a great hysteresis characteristic was confirmed when the angle θ was 0°, 22.5°, 45°, 135°, 157.5°, and 180°. As shown in FIGS. 5D and 5F, a hysteresis was also confirmed when the angle θ was 67.5°, and 112.5°, but it was extremely smaller than the case in which the angle θ was 0°, 22.5°, 45°, 135°, 157.5°, and 180°. As shown in FIG. 5E, the hysteresis characteristic was not confirmed in the case in which the angle θ was 90°. It was found from the result of the experiment described above that little hysteresis characteristic was caused and the position of the plunger 41 could correctly be detected with the angle θ within the range of 90°±20°. Further, it was found from the result of the experiment that no hysteresis characteristic was confirmed and the position of the plunger 41 could be detected most correctly when the angle θ was set to 90°.

According to the keyboard apparatus 100 described above, a feeling of a touch close to a natural instrument is obtained by applying a driving force to the rear side from the support C1 of the white key 10 and the black key 11, but the invention is not limited thereto. For example, the driving unit 30 may be mounted such that the plunger 41 is brought into contact with the lower surface of the white key 10 and the black key 11 at the front side from the support C1, whereby the reaction force may be applied from below the white key 10 and the black key 11.

The embodiment described above is only illustrative, and the present invention is not limited to the embodiment described above. Specifically, various modifications are possible without departing from the scope of the present invention.

What is claimed is:

1. A keyboard apparatus comprising:

plural keys that extend along a longitudinal axis in the direction of each of the keys, and pivot in the vertical direction about a support by the operation of depressing the keys and releasing the keys;

plural electronic actuators that respectively apply a reaction force against the operation of depressing the plural keys, each of the electronic actuators including a movable member that displaces in the vertical direction interlocked with the pivot movement of each of the plural keys;

plural reflection plates that are fixed to the movable members of the plural electronic actuators respectively in such a manner that an axis orthogonal to a surface of each reflection plate intersects the longitudinal axis of the keys, wherein the light reflectance of each of the reflection plates changes along the displacing direction of each of the movable members; and plural optical sensors, each of which is arranged at the position apart from the longitudinal axis of each of the keys in the lateral direction in such a manner that the distance between each reflection plate and each optical sensor is substantially constant whereby any clatter effect along the longitudinal direction is minimized, emits light toward each of the plural reflection plates, receives reflected light from each of the plural reflection plates so as to output an electrical signal according to the quantity of the received light, and detects displacement of the movable members of the plural electronic actuators, wherein each of the optical sensors is composed of a light emitting device that faces each of the reflection plates and emits light toward the reflection plate, and a light receiving device that faces each of the reflection plates and receives light from the light emitting device reflected by the reflection plate so as to output an electric signal according to the quantity of the received light, and wherein each of the optical sensors is arranged so that a light beam emitted from the light emitting device intersects the displacing direction of the movable member.

2. A keyboard apparatus according to claim 1, wherein each of the electronic actuators applies a reaction force against the operation of depressing each of the keys through each of the movable members at the position at the front side from the support of each of the keys.

3. A keyboard apparatus according to claim 1, wherein each of the electronic actuators applies a reaction force against the operation of depressing each of the keys through each of the movable members at the position at the rear side from the support of each of the keys.

4. A keyboard apparatus according to claim 1, wherein the angle between the longitudinal axis of each of the keys and the direction orthogonal to the surface of each of the reflection plates is 70° or more and 110° or less.

5. A keyboard apparatus according to claim 1, wherein the angle between the longitudinal axis of each of the keys and the direction orthogonal to the surface of each of the reflection plates is 90°.

* * * * *